United States Patent [19]

Baum et al.

[11] 4,190,121

[45] Feb. 26, 1980

[54] THERMAL DRILLING DEVICE

[75] Inventors: Werner Baum, Flein; German Munding, Bad Friedrichshall, both of Fed. Rep. of Germany

[73] Assignee: Messerschmitt-Bölkow-Blohm GmbH, Fed. Rep. of Germany

[21] Appl. No.: 871,822

[22] Filed: Jan. 24, 1978

Related U.S. Application Data

[62] Division of Ser. No. 734,424, Oct. 21, 1976, Pat. No. 4,076,082.

[30] Foreign Application Priority Data

Feb. 20, 1976 [DE] Fed. Rep. of Germany ..... 2607046

[51] Int. Cl.[2] ..... E21B 7/14

[52] U.S. Cl. ..... 175/14; 266/904; 175/15

[58] Field of Search ..... 175/11, 14, 15, 16; 239/589, 597, 599, 601; 266/904; 413/158

[56] References Cited

U.S. PATENT DOCUMENTS

| | | | |
|---|---|---|---|
| 2,266,834 | 12/1941 | Walker et al. | 239/599 X |
| 2,426,688 | 9/1947 | Higgs | 175/11 X |
| 2,638,976 | 5/1953 | Vixler | 239/601 X |
| 2,725,929 | 12/1955 | Massier | 175/14 X |
| 2,866,622 | 12/1958 | Murray | 175/15 |
| 3,172,457 | 3/1965 | Hartmann et al. | 266/904 X |
| 3,182,734 | 5/1965 | Scott | 175/15 X |
| 3,358,783 | 12/1967 | Raynal et al. | 239/597 |
| 3,623,437 | 11/1971 | Lusser | 239/597 X |
| 3,687,375 | 8/1972 | Griffiths | 239/601 X |
| 3,756,511 | 9/1973 | Shinroku | 239/599 X |

FOREIGN PATENT DOCUMENTS

| | | | |
|---|---|---|---|
| 1179093 | 1/1970 | United Kingdom | 175/11 |

*Primary Examiner*—James A. Leppink
*Assistant Examiner*—Richard E. Favreau
*Attorney, Agent, or Firm*—McGlew and Tuttle

[57] ABSTRACT

A thermal drilling device which operates in a rotary or circumferentially oscillatory motion and which is particularly adapted for drilling geological formations comprises a drill body which has an interior combustion chamber with a bottom having an outlet defining a discharge nozzle. Means are provided for adding fuel components into the combustion chamber and for igniting them to generate hot gaseous products of combustion which are discharged through a nozzle slot arranged at the bottom of the combustion chamber. The nozzle slot extends diametrically of the drilling area at the bottom and slot outline or a plurality of slots arranged symmetrically relative to the longitudinal axis of the drilling body.

2 Claims, 5 Drawing Figures

THERMAL DRILLING DEVICE

This is a divisional of application Ser. No. 734,424 filed Oct. 21, 1976 now U.S. Pat. No. 4,076,082.

BACKGROUND OF THE INVENTION

1. Field of the Invention

This invention relates in general to the construction of thermal drilling devices and in particular to a new and useful drill particularly for drilling geological formations which includes means for generating gaseous products of combustion in an interior combustion chamber of the drill and for discharging them through a nozzle having a slot discharge opening.

2. Description of the Prior Art

Various thermal drive devices are known for drill constructions. They comprise substantially a combustion chamber into which mostly liquid fuel and oxygen are fed and which react to produce hot drilling gases and they include a discharge nozzle for the hot drilling gases which is provided downstream of the combustion chamber and which has a circular cross-section. In addition they include means for accommodating a water cooling system and in some cases additional mechanical drilling heads with cutting tools for reaming the thermally rough drilled hole and finally means for supplying the operating fluids. With such devices the drilling is effected so that the hot drilling jet melts or cleaves the rock by the applied heat while the water which is simultaneously applied is vaporized and the steam under pressure entrains the drillings upwardly.

SUMMARY OF THE INVENTION

The present invention provides an improved drilling device which has a combustion chamber for generating gaseous products of combustion and which includes a discharge nozzle of a slot shaped construction. The nozzle may comprise a single slot extending diametrically across the drilling area or a plurality of nozzle slots are provided which extend along a diameter of the drilling area and are symmetrically arranged in respect to the longitudinal axis of the drilling device. A plurality of radially extending and annularly or circumferentially spaced individual nozzle slots may be provided.

The effect obtained with the discharge nozzle of the inventive construction along with a rotary motion or an oscillation in the circumferential direction of the discharge nozzle or nozzles, is that the respective portion of the whole bottom opposite to the nozzle slot is instantaneously heated more than the other adjacent portion so that alternately in the direction of rotation local heat shock regions and cooling regions are produced in the bottom of the hole. This results in a thermal blasting and then a spalling of the layer. By providing a a slot shaped configuration of the discharge nozzle or nozzles together with the rotary or oscillatory motion, an uninterrupted sweeping of the hole bottom and accomplished work resulting therefrom is obtained.

In a further development of the invention the individual discharge nozzles are shaped so that their width grows larger in an outward direction. This results in a particular advantage that with regard to the respective covered area of the bottom, the rate of heat supply is specifically equalized that is during a single revolution of the device approximately the same heat amount is applied to each unit of the hole bottom area.

Accordingly it is an object of the invention to provide an improved thermal drilling device which operates in a rotary or circumferentially oscillatory motion and particularly for drilling geological formations which comprises a drill body which has an interior combustion chamber with a bottom having an outlet defining a discharge nozzle and which includes means for generating hot gaseous products of combustion in the combustion chamber which are discharged through the nozzle and wherein the nozzle is of a slot shaped configuration.

A further object of the invention is to provide a thermal drilling device which is simple in design, rugged in construction and economical to manufacture.

The various features of novelty which characterize the invention are pointed out with particularity in the claims annexed to and forming a part of this disclosure. For a better understanding of this invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
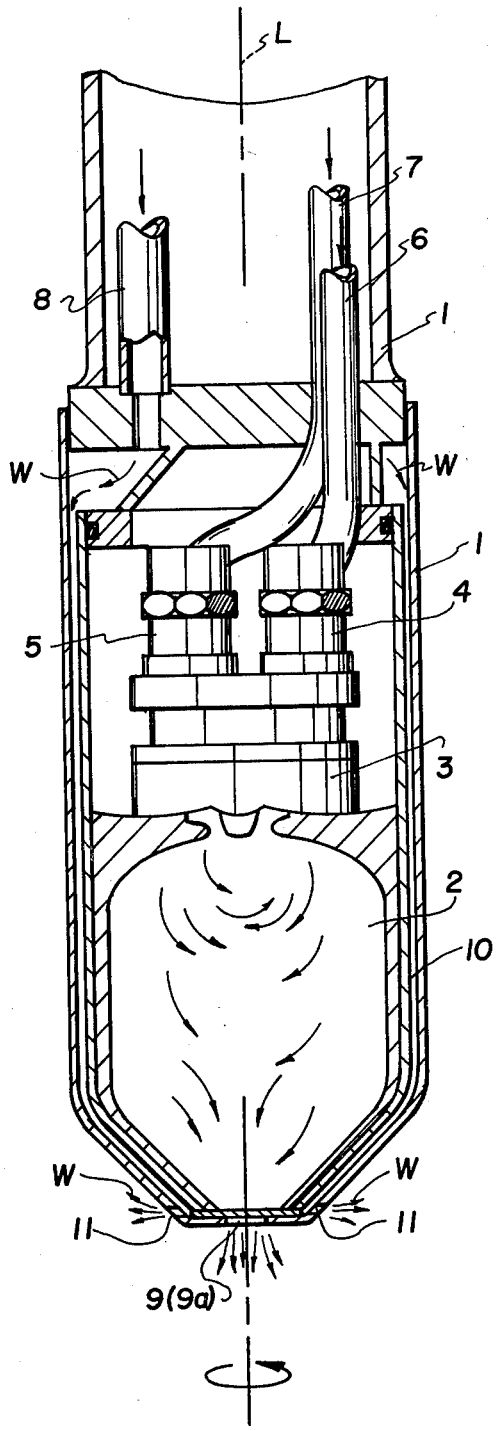
FIG. 1 is a partial longitudinal sectional view of a drilling device constructed in accordance with the invention.
Figure 2:
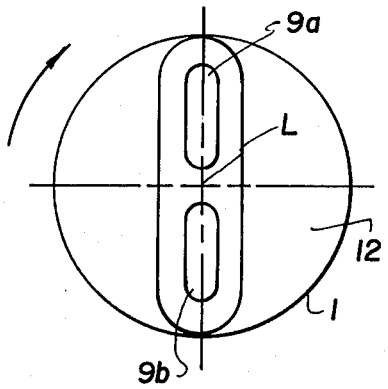
FIGS. 2 to 5 are bottom or end plan views of various embodiments of drill body constructed in accordance with the invention.

Referring to the drawings in particular the invention as embodied in FIGS. 1 and 2 comprises a drilling device which includes a drill body or housing 1 having an interior combustion chamber 2 therein with a head portion 3 having fuel feed fittings 4 and 5 which are connected to fuel supply lines 6 and 7 respectively. In addition the body contains a supply line 8 for cooling water. Gaseous products of combustion are generated in a combustion chamber 2 and they exit through a gas discharge nozzle 9 A free intermediate space or cooling space 10 is provided between inner and outer walls of the housing 1 for the flow of cooling water W therethrough from the top to the bottom. At the bottom the water flows out through radially extending bores 11 and it is vaporized due to the heat of the hot gas jets which are repelled from the hole bottom and which flow upwardly and thus contribute to the cooling of the drilling device from the outside in addition to the inside. The longitudinal axis of the drilling device is designated by L.

As shown in FIG. 2 the nozzle comprises two oblong slots *9a* and *9b* which are located diametrically of a bottom 12 and symmetrically of the longitudinal axis L of the drilling device.

Figure 3:
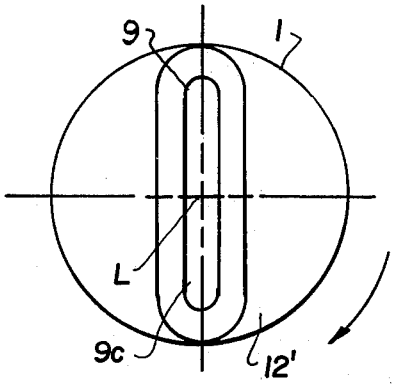

In the embodiment shown in FIG. 3 the discharge nozzle includes one oblong slot *9c* by means of which a hole bottom 12' is evacuated not along a horizontal or flat level but conically because the heat supply is specifically greater in the central area of the slot *9c*.

Figure 4:
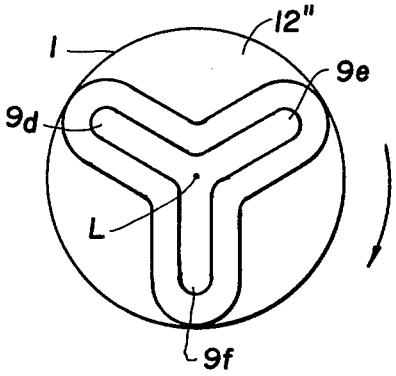

In the embodiment of FIG. 4 the nozzle slot comprises three separate branches *9d*, *9e* and *9f* which extend radially and are disposed at equal angles to each other symmetrically of the longitudinal axis L.

Figure 5:
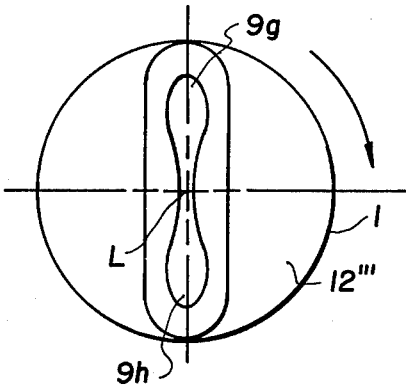

In the embodiment of FIG. 5 a single slot is formed on a bottom 12''' which is formed of two oppositely directed V-shaped slots 9g and 9h. The slots narrow toward the center at which they are joined. They extend in a radial direction and widen toward each respective outer end.

The configuration of the drilling nozzle corresponds to a flat mechanical drill bit. Because of the rotary oscillatory motion of the drilling nozzle circulating or reciprocating thermal peak loads are locally distributed over the hole bottom and these cause high mechanical stresses in the hole bottom and thereby a disintegration of even very hard rock formations.

While specific embodiments of the invention have been shown and described in detail to illustrate the application of the principles of the invention, it will be understood that the invention may be embodied otherwise without departing from such principles.

What we claim is:

1. A thermal drilling device operating in a rotary motion, particularly for drilling geological formations, comprising a drill body having an interior combustion chamber with a bottom having an outlet defining a discharge nozzle, said drill body being rotatable about an axis of rotation, means for generating hot gaseous products of combustion in said combustion chamber, said discharge nozzle having a plurality of radially extending slots which intersect at the center of said drill axis of rotation and define discharge openings for the hot gases.

2. A thermal drilling device operating in a rotary motion, particularly for drilling geological formations, comprising a drill body having an interior combustion chamber with a bottom having an outlet defining a discharge nozzle, said drill body being rotatable about an axis of rotation, means for generating hot gaseous products of combustion in said combustion chamber, said discharge nozzle having at least two discharge passages terminating in nozzle slots defining discharge openings for the hot gases which extend diametrically and symmetrically of the axis of rotation, said passages and said slots having cross sections and shapes which are equal to each other.

* * * * *